US005388653A

United States Patent [19]

England

[11] Patent Number: 5,388,653

[45] Date of Patent: Feb. 14, 1995

[54] DIRECTIONAL DRILLING APPARATUS

[76] Inventor: J. Richard England, 1021 Dublin Street, Sudbury, Ontario, Canada, P3A 1R5

[21] Appl. No.: 45,183

[22] Filed: Apr. 13, 1993

[30] Foreign Application Priority Data

Mar. 11, 1993 [CA] Canada ..... 2091529

[51] Int. Cl.[6] ..... E21B 3/02

[52] U.S. Cl. ..... 175/122; 175/162; 175/220

[58] Field of Search ..... 175/122, 162, 170, 220, 175/189

[56] References Cited

U.S. PATENT DOCUMENTS

| | | | |
|---|---|---|---|
| 3,282,357 | 11/1966 | Bunn | 175/122 |
| 4,858,704 | 8/1989 | McDonald et al. | 175/61 |
| 4,953,638 | 9/1990 | Dunn | 175/61 |
| 5,133,418 | 7/1992 | Gibson et al. | 175/45 |

FOREIGN PATENT DOCUMENTS

| | | | |
|---|---|---|---|
| 703371 | 2/1965 | Canada | 175/122 |
| 840334 | 6/1981 | U.S.S.R. | 175/122 |
| 1102934 | 7/1984 | U.S.S.R. | 175/122 |
| 1137197 | 1/1985 | U.S.S.R. | 175/122 |

*Primary Examiner*—Hoang C. Dang

*Attorney, Agent, or Firm*—McFadden, Fincham, Marcus & Anissimoff

[57] ABSTRACT

A drilling apparatus for directional drilling. A freely moveable connecting plate is seated in a seating provided for in a drill string motor support. The plate connects a drill string motor and a cylinder drive so that any mechanical stress transmitted by a drill string connected to the motor is substantially damped by the moveable plate. The result is that the drill string remains relatively true running to accurately bore while additionally preventing mechanical stress from damaging the cylinder, drill string motor or support therefor.

16 Claims, 4 Drawing Sheets

DIRECTIONAL DRILLING APPARATUS

FIELD OF THE INVENTION

The present invention relates to a directional drilling arrangement and more particularly, the invention relates to an improved support arrangement employed for directional drilling.

BACKGROUND OF THE INVENTION

In general overview, guided earth boring is required to bore long holes for reception of gas lines, electrical conduits, communication conduits, etc.

In a conventional manner, a series of drill pipes, which collectively form a drill string when interconnected, are joined to a motor for rotating the same. At an opposite end, a bit, reamer or percussion device is connected to permit the drilling. Clearly, the greater the horizontal distance becomes, the greater the number of drill pipes associated with the drill string. With greater length, coupled with the fact that enormous forces are involved at the drilling bit, there is a high degree of kinking and flexing in the drill string. The result is that the forces from this motion is translated to the drill string motor and the support thereof.

The effect of the irregular motion of the drill string is most pronounced at the drill face. The drill bit is incapable of drilling a substantially horizontal bore and further, the dimension of the bore enlarges due to the lack of control at the drilling face.

The prior art has set forth a host of patents which relate to apparatuses to effect horizontal drilling, typical of which is U.S. Pat. No. 4,953,638. The patent teaches an apparatus including a channel bearing frame for receiving a wheeled drill string motor. There is no provision for any lateral or elevational tolerance when the motor is carried by the carriage. Accordingly, this reference would not appear to be adapted for dampening the forces experienced at the interface of the motor and carriage. Further, this reference does not provide any multiple sleeved cylinder means as the primary drive of the drill string motor along the carriage thereof.

A further earth boring apparatus which is known in the art is disclosed in U.S. Pat. No. 4,858,704. Similar to U.S. Pat. No. 4,953,638, this specification provides a drill rig moveably mounted on a track assembly. There is no discussion or contemplation of any arrangement for damping stress received at the drill motor rig from the drill string. In this reference, it would appear that the apparatus would not be well suited to actuate boring since the same does not even provide a drill string support on the drill rig carriage. Further, although the patentees have disclosed the possibility of employing fluid cylinder means as the drive source for the rig, there has been no provision for addressing the problem of cylinder sag inherent when the rig advances along the track.

A further arrangement broadly related to the subject matter of the present invention is taught in U.S. Pat. No. 5,133,418. The arrangement disclosed lacks a support for the drill string motor capable of accommodating lateral and/or elevational movement thereof. Accordingly, any stress of this variety would be, since the motor is rigidly connected to the frame, absorbed by the drill string. This may result in inaccurate boring as indicated herein previously and could also result in forces being transmitted to the connection between the drill string motor and the drive therefor. In the case where the drive may be a cylinder, this could result in cylinder damage.

SUMMARY OF THE INVENTION

One object of the present invention is to provide an improved apparatus for directional drilling.

A further object of the present invention is provide a directional drilling apparatus, comprising: a frame; a drill string motor means having a drill string connected thereto; cylinder means for advancing and retracting the drill string motor means longitudinally along the frame; a motor mounting means for supporting the drill string motor means; the mounting means including a seat; and a freely moveable connecting member seated in the seat for connecting the drill string motor means and the cylinder means and moveable in response to motion transmitted by the drill rod.

Another object of the present invention is to provide a drilling apparatus having a frame, a drill string motor moveably mounted on the frame for longitudinal movement therealong, the motor, including at least one drill rod and a bit and cylinder means for moving the drill string motor, the improvement comprising: a motor mounting means for supporting the drill string motor, the mounting means including a seat; and a freely moveable connecting member seated in the seat for connecting the drill string motor and the cylinder means and moveable in response to motion transmitted by the drill rod.

Having thus generally described this invention, reference will now be made to the accompanying drawings, illustrating preferred embodiments.

DETAILED DESCRIPTION OF A PREFERRED EMBODIMENT

Figure 1:
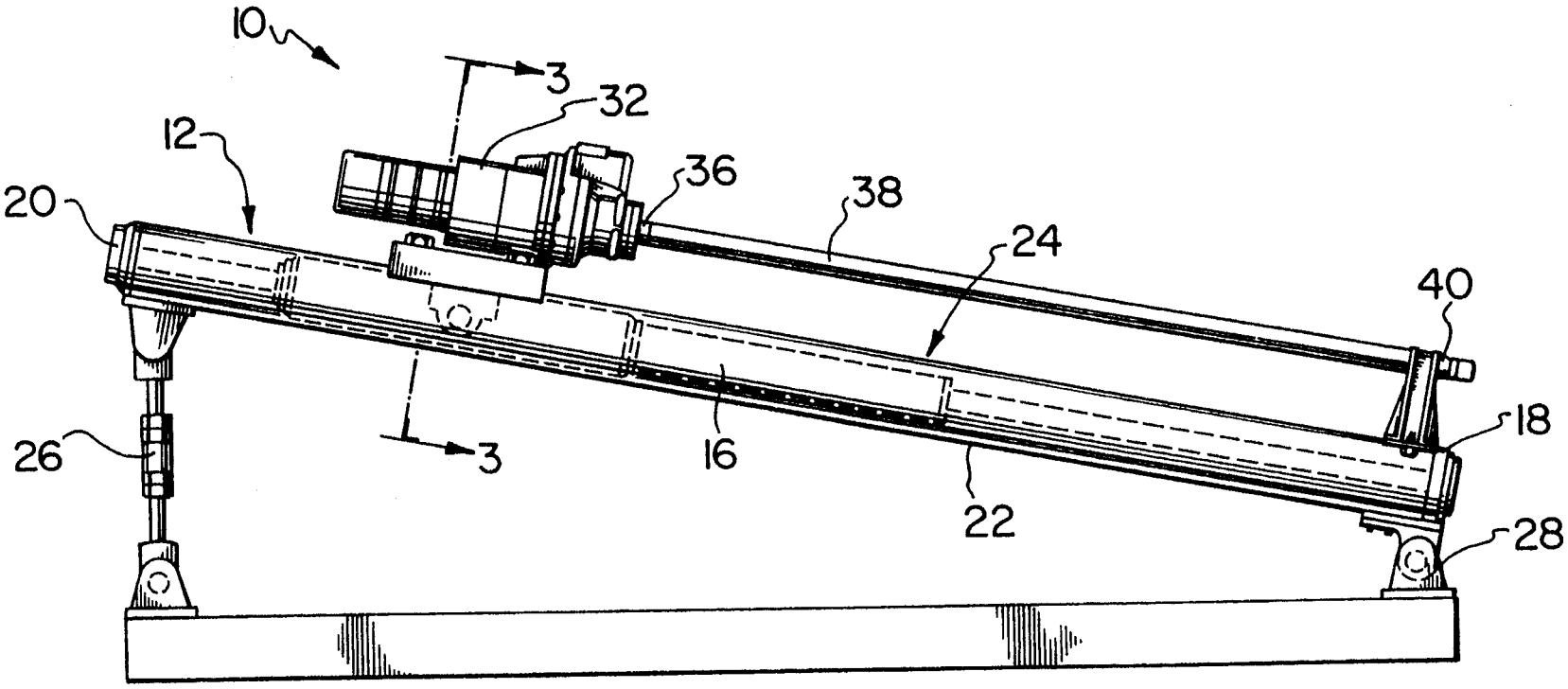
FIG. 1 is a side view of an embodiment of the overall apparatus.

Referring now to the drawings, FIG. 1 shows the overall apparatus 10. A frame 12 is provided with spaced apart side walls 14 and 16, end walls 18 and 20, bottom wall 22 and open top 24. Adjustable frame supports 26 and 28 are connected adjacent a respective end wall 18 and 20 for adjusting the inclination and/or height of frame 12.

Figure 2:
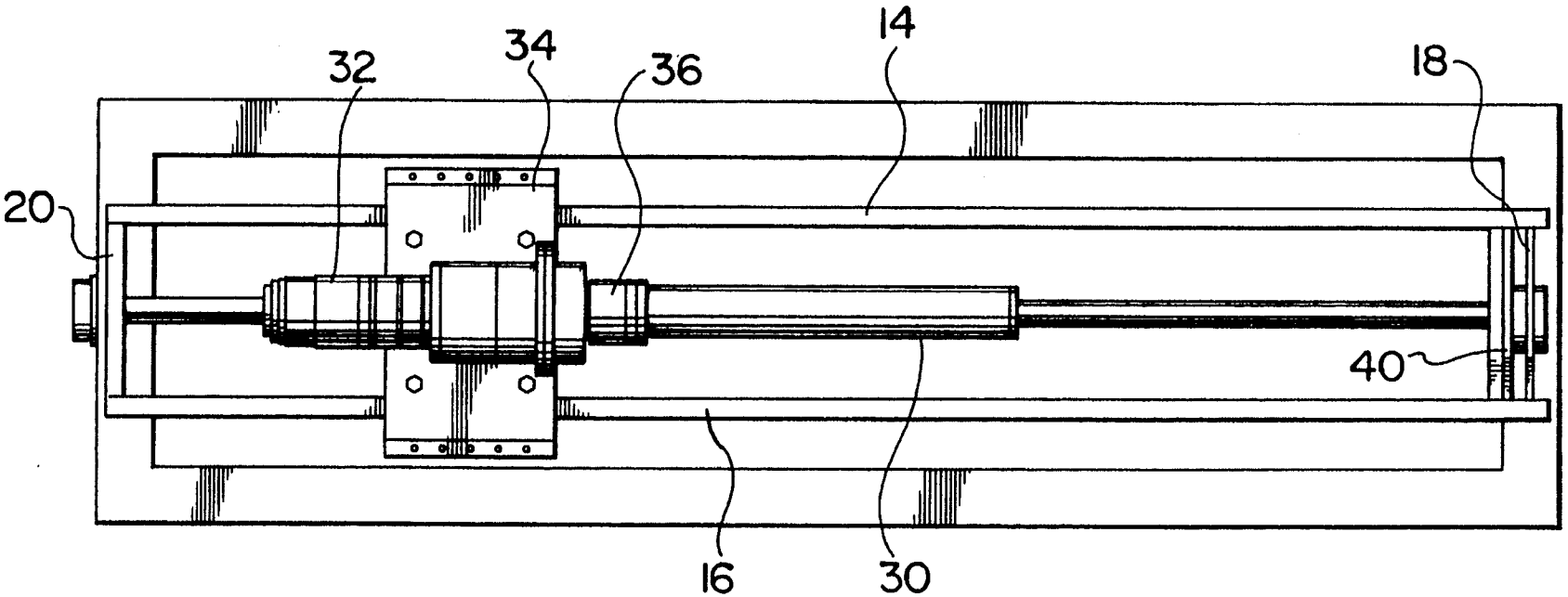
FIG. 2 is a plan view of FIG. 1.

Frame 12 includes a multiple sleeve cylinder 30, shown more clearly in FIG. 2. The cylinder 30 serves as the primary drive for driving drill string motor 32 connected therewith along the frame 12. The drill string motor 32 provides a support 34 for supporting the motor 32 and extends between side walls 14 and 16 for contact on the top surface thereof (discussed in greater detail hereinafter). The drill string motor 32 provides a coupling 36 for connecting a drill rod 38 thereto. A drill string guide member 40, positioned adjacent the front end wall 18, slidably receives the drill rod 38.

Figure 3:
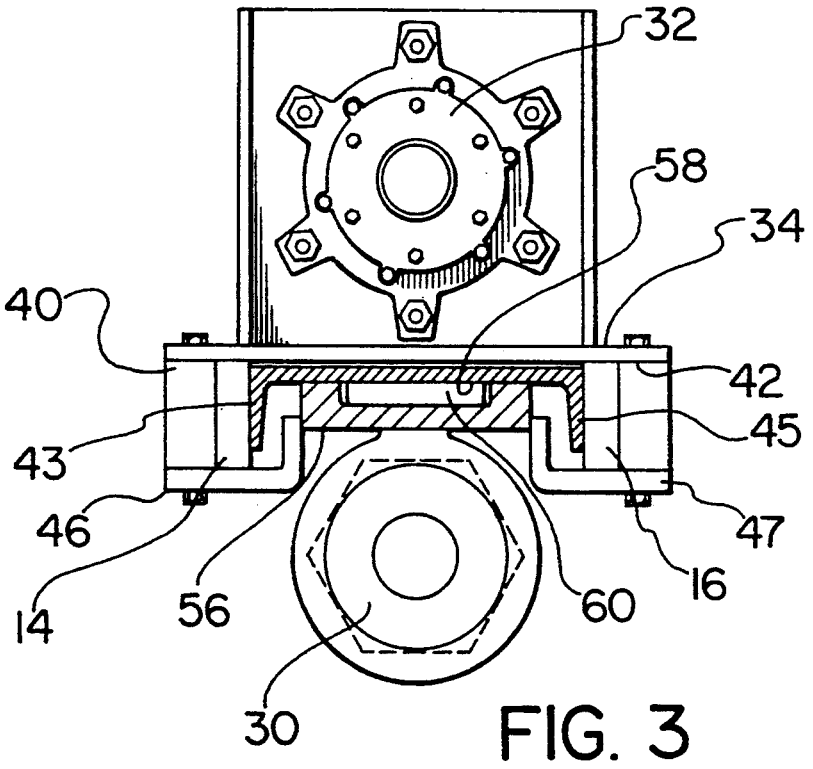
FIG. 3 is a sectional view along line 3-3 of FIG. 1
Figure 4:
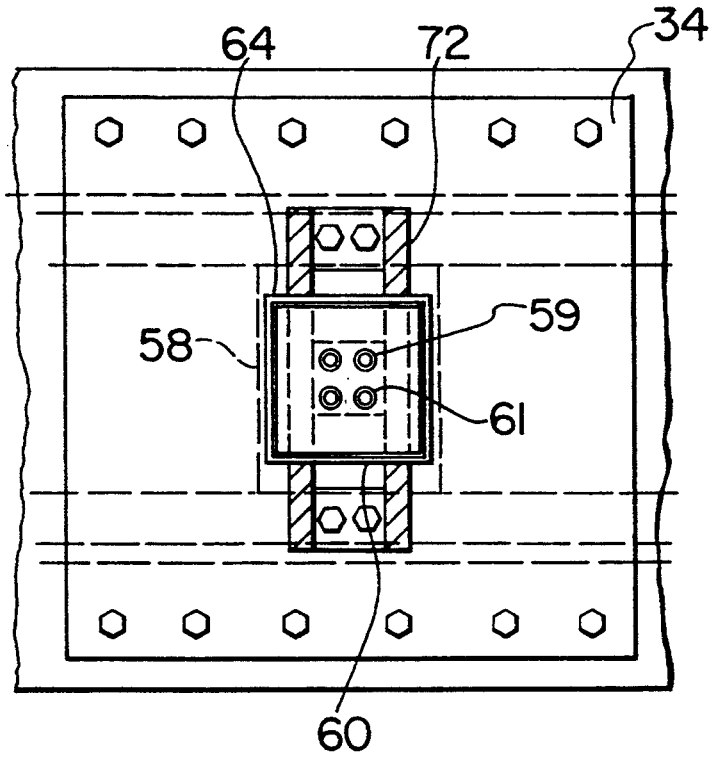
FIG. 4 is a top plan view of FIG. 3 with parts removed.

FIGS. 3 and 4 more clearly illustrate the relationship between the drill string motor 32, frame 12 and cylinder 30 with elements removed for clarity.

The support 34 provides guides 40 and 42 and flanges 43 and 45 for guided sliding contact with walls 14, 16, respectively of frame 12, respectively. The stability of the support 34 is enhanced by the provision of bolted clamping members 46 and 47.

The clamping members 46 and 47 cooperate with guides 40 and 42 and support 34 to secure the arrangement into abutting contact with flanges 43 and 45.

Beneath support 34 there is provided a seat 56 configured to receive a connecting member 60 as illustrated in FIGS. 3 and 4. The seat 56 is recessed within support 34 relative to a top surface thereof and includes a plurality of spaced apart walls 58. A narrow opening 59 is provided in the base of seat 56. This is illustrated in top plan view in FIG. 4 and sectionally in FIG. 3. Opening 59 permits connection of member 60 with cylinder 30.

The connecting member 60 is seated in seat 56. Member 60 connects, via fasteners 61, the drill string motor 32 and the cylinder 30 and comprises a plate for positioning within seat 56. The seat is structured such that member 60 is spaced inwardly of the seat 56, and more particularly walls 58, as illustrated by numeral 64 in FIG. 4.

As is illustrated in the drawings, member 60, although spaced from the motor and inwardly of seat 56, is retained within support 34. The spacings indicated permit free movement of member 60 transversely and longitudinally relative to the longitudinal direction and thus permits movement of cylinder 30 and motor 32.

In addition, the member is pivotally moveable relative to a vertical axis to a limited degree within seat 56. Limited elevational or vertical movement relative to the frame 12 is also available. The latter is possible due to the provision of the narrow opening 59 in seat 56, the former permitting connection to cylinder 30 and by virtue of the fact that member 60 is recessed from a top surface of member 34 for seating in seat 56. The size of the opening 59 will, of course, be of a lesser dimension than the dimension of the connecting member 60.

The arrangement indicated has been found to be particularly effective in preventing irregular motion of the drill string as well as substantially reducing the stress at the drill string motor 32 and hence the cylinder 30. By providing the free moveable plate with the same, effectively dampens motion translated from the drill string during a drilling procedure.

Figure 5:
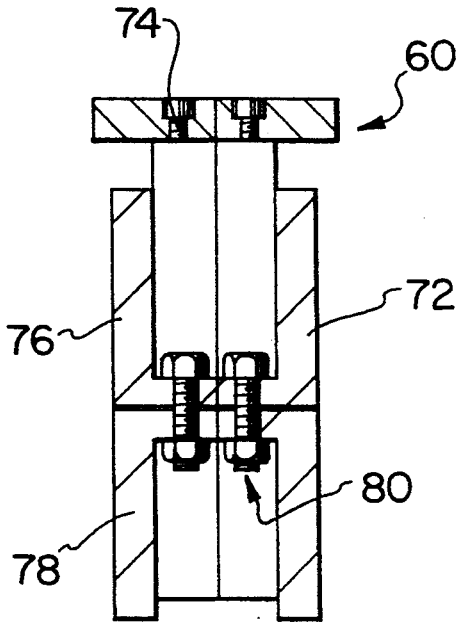
FIG. 5 is a side elevational view of an embodiment of the connecting member and a collar for use therewith.
Figure 6:
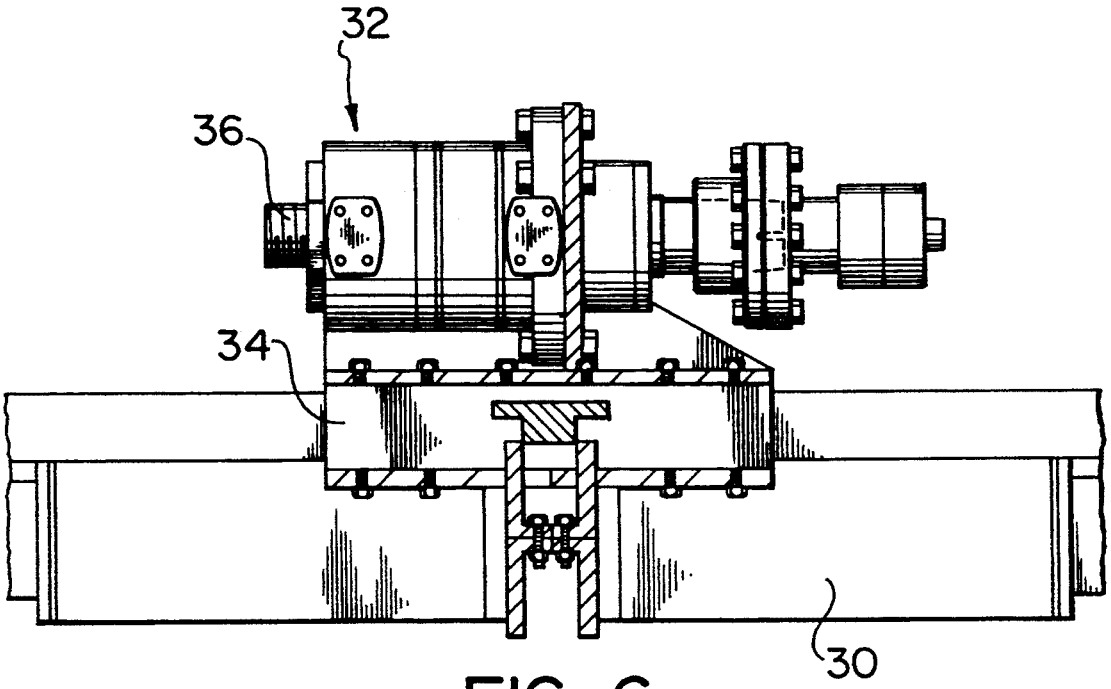
FIG. 6 is a side view illustrating, in one embodiment, the positioning of the connecting member and collar in use.

In order to further enhance the effectiveness of the present invention, a cylinder collar 72 may be included for surrounding cylinder 30 (not shown) and connected to plate 60 via bolts 74. This is illustrated in FIG. 5. The collar 72, as shown in the example, may comprise two semi-circular sections 76 and 79 connected by fasteners 80. The provision of the collar 72 adds support to the cylinder to substantially alleviate sag therein as the motor 32 is advanced along frame 12. In addition to the inclusion of collar 72, the cylinder 30 may be prestressed to impart additional strength as readily appreciated by those skilled in the art. This procedure, in combination with collar 72, prevents sag in cylinder 30.

It will be readily appreciated that when alternate forms of drive means other than a multiple sleeved cylinder are employed, the collar 72 may be absent and plate 60 suitably connected to the alternate drive source. Various forms for the drive include, for example, screw arrangements, rack and pinion systems, chain drive and other related mechanical arrangements capable of and suitable for driving the drill string motor along the frame.

Although embodiments of the invention have been described above, it is not limited thereto and it will be apparent to those skilled in the art that numerous modifications form part of the present invention insofar as they do not depart from the spirit, nature and scope of the claimed and described invention.

I claim

1. A directional drilling apparatus, comprising:

a frame;

a drill string motor means having a drill string connected thereto cylinder means for advancing and retracting said drill string motor means longitudinally along said frame;

a motor mounting means for supporting said drill string motor means movable longitudinally along said frame;

said mounting means including a seat; and a connecting member seated in said seat and freely moveable relative thereto for directly connecting said drill string motor means and said cylinder means and moveable in response to motion transmitted by said drill rod.

2. The directional drilling apparatus as set forth in claim 1, wherein said cylinder means is a multiple sleeved cylinder extending within said frame.

3. The directional drilling apparatus as set forth in claim 2, wherein said cylinder is prestressed in longitudinal direction.

4. The directional drilling apparatus as set forth in claim 2, wherein said connecting member includes a cylinder retaining member for preventing sag in said cylinder as said motor means is advanced on said frame.

5. The directional drilling apparatus as set forth in claim 1, wherein said connecting member is seated in said seat at least for limited transverse movement therein relative to said longitudinal movement.

6. The directional drilling apparatus as set forth in claim 1, wherein said connecting member is adapted for limited vertical movement in said seat relative to said frame.

7. The directional drilling apparatus as set forth in claim 1, wherein said connecting member comprises a plate.

8. In the drilling apparatus having a frame, a drill string motor moveably mounted on said frame for longitudinal movement therealong, said motor, including at least one drill rod and a bit and cylinder means for moving said drill string motor, the improvement comprising:

a motor mounting means for supporting said drill string motor, said mounting means being movable longitudinally along said frame including a seat; and a connecting member seated in said seat and moveable relative thereto for directly connecting said drill string motor and said cylinder means and moveable in response to motion transmitted by said drill rod.

9. The directional drilling apparatus as set forth in claim 8, wherein said cylinder means is a multiple sleeved cylinder extending within said frame.

10. The directional drilling apparatus as set forth in claim 9, wherein said cylinder is prestressed in a longitudinal direction.

11. The directional drilling apparatus as set forth in claim 9, wherein said connecting member includes a cylinder retaining member for preventing sag in said cylinder as said motor means is advanced on said frame.

12. The directional drilling apparatus as set forth in claim 8, wherein said connecting member is adapted for limited transverse movement therein relative to said longitudinal movement.

13. The directional drilling apparatus as set forth in claim 8, wherein said connecting member is adapted for limited vertical movement relative to said seat.

14. The directional drilling apparatus as set forth in claim 8, wherein said connecting member is adapted for limited longitudinal movement within said seat relative thereto.

15. The directional drilling apparatus as set forth in claim 8, wherein said connecting member is adapted for limited pivotal movement within said seat relative to a vertical axis thereof.

16. The directional drilling apparatus as set forth in claim 8, wherein said connecting member comprises a plate.

* * * * *